US007089866B2

(12) United States Patent
Alculumbre et al.

(10) Patent No.: US 7,089,866 B2
(45) Date of Patent: Aug. 15, 2006

(54) SMALL ARMS PROJECTILE

(75) Inventors: Michael Alculumbre, London (GB); Fred Sharp, London (GB)

(73) Assignee: Olympic Technologies Limited, Gibraltar (GB)

( * ) Notice: Subject to any disclaimer, the term of this patent is extended or adjusted under 35 U.S.C. 154(b) by 0 days.

(21) Appl. No.: 10/474,541

(22) PCT Filed: Apr. 8, 2002

(86) PCT No.: PCT/GB02/01647

§ 371 (c)(1),
(2), (4) Date: Mar. 1, 2004

(87) PCT Pub. No.: WO02/084205

PCT Pub. Date: Oct. 24, 2002

(65) Prior Publication Data

US 2004/0144887 A1 Jul. 29, 2004

(30) Foreign Application Priority Data

Apr. 12, 2001 (GB) ..... 0109277.4

(51) Int. Cl.
*F42B 14/06* (2006.01)

(52) U.S. Cl. ..... 102/523

(58) Field of Classification Search ..... 102/532, 102/522, 523; 244/3.29
See application file for complete search history.

(56) References Cited

U.S. PATENT DOCUMENTS

| | | | | |
|---|---|---|---|---|
| 3,580,529 | A * | 5/1971 | Suter | 244/3.29 |
| 4,232,843 | A * | 11/1980 | Clark et al. | 244/3.29 |
| 5,189,250 | A | 2/1993 | Shaphyr | |

FOREIGN PATENT DOCUMENTS

| | | | |
|---|---|---|---|
| DE | 19944379 | A1 | 3/2001 |
| EP | 0499907 | B1 | 8/1992 |
| GB | 1516073 | A | 6/1978 |
| GB | 2153982 | * | 8/1985 |
| WO | WO 86/06467 | * | 11/1986 |
| WO | WO 99/51934 | A1 | 10/1999 |

* cited by examiner

*Primary Examiner*—T. Nguyen
(74) *Attorney, Agent, or Firm*—Lawrence E. Laubscher, Jr.

(57) ABSTRACT

A projectile (1) for a small arms weapon having a muzzle, the projectile having a casing (2) and fins (3), pivotally mounted upon said casing and urged outwardly of the casing, for automatic deployment after leaving the muzzle; wherein the casing is disposed within a cartridge having a sleeve surrounding the casing and fins; the cartridge also containing a propellant charge intended, when detonated, to propel the projectile out of the muzzle; and wherein shielding means (6) is provided to shield said fins and/or their pivotal mountings, at least in part, from the detonation of said propellant.

8 Claims, 1 Drawing Sheet

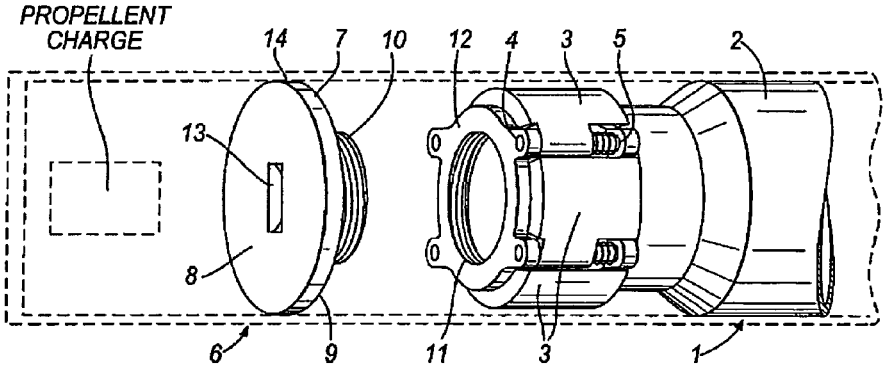
PROPELLENT
CHARGE
14
7
10
12
4
3
5
2
13
8
6
9
11
3
1

SMALL ARMS PROJECTILE

This application claims priority from United Kingdom Application No. 0109277.4 filed Apr. 12, 2001 and PCT Application No. PCT/GB02/01647 filed Apr. 8, 2002.

BACKGROUND OF THE INVENTION

The present invention relates to small arms projectiles, and especially to such projectiles as are fitted with stabilizing tins and which are intended to be fired from a cartridge.

DESCRIPTION OF THE PRIOR ART

In our International Patent Application No. WO 99/51934, there is described a small arms projectile, preferably fired from a cartridge, for a smooth bore weapon. The cartridge contains a propellant charge, and the projectile comprises a generally cylindrical casing containing, at its front end, a warhead assembly comprising an explosive charge and an associated initiator.

The aforesaid international application is principally concerned with safety issues and, in particular, provides multiple mechanisms to retain a firing pin in a safety position prior to fixing, and release part of the firing pin mechanism on application of the acceleration forces typically experienced upon initiation of the propellant. One of the safety mechanisms relies upon the stabilizing fins, in their folded positions, securing two or more safety pins whilst the projectile is stored in the cartridge or when being fired in the chamber and barrel of a smooth bore weapon.

The projectiles are preferably stabilized in flight by means of stabilizing fins which are disposed to the rear end of the casing, and are hinged upon pivots running parallel to the casing axis. These fins are, in turn, restrained against the body of the casing by the cartridge sleeve until firing, and are then restrained by the internal surface of the barrel of the weapon. The fins are thus intended to be deployed on exit from the chamber.

A difficulty that is sometimes experienced with projectiles of the kind just described, however, is that the cartridge sleeve, which is typically of plastics or other relatively weak material can become distorted, or even breached, after detonation of the propellant charge, whilst the cartridge is still in the muzzle. Such distortion or breach can result in unreliable firing and/or the deposition of residues of the sleeve material within the bore of the weapon used.

SUMMARY OF THE INVENTION

It is an object of this invention to address these difficulties by means which are rugged, reliable and preferably also economical to provide and fit.

According to the invention there is provided a projectile for a small arms weapon having a muzzle, the projectile having a casing and fins, pivotally mounted upon said casing and urged outwardly of the casing, for automatic deployment after leaving the muzzle; wherein the casing is disposed within a cartridge having a sleeve surrounding the casing and fins; the cartridge also containing a propellant charge intended, when detonated, to propel the projectile out of the muzzle and wherein shielding mean is provided to shield said fins and/or their pivotal mountings, at least in part, from the detonation of said propellant.

Extensive research into possible causes of the aforesaid distortion or breach of the cartridge sleeve has revealed that it is due, at least in part, to unwanted movement, typically twisting movement, of said fins upon the pivotal mounts whereby they are secured to the casing in response to the detonation of the propellant charge.

By means of the invention, the fins and/or their pivotal mounts are shielded, at least in part, from the detonated charge and thus their aforesaid unwanted movements are reduced, enabling the fins to remain closely against the side of the projectile's casing until the projectile has completely disengaged from the cartridge. In addition, this greatly assists in efficiently transferring the energy from the propellant charge to the projectile and, in doing so, achieves a consistent chamber pressure and muzzle velocity.

Preferably, the shielding means comprises a substantially discoidal member disposed coaxially with the casing and located between the projectile and the propellant charge. This provides an effective shield which is economic both to produce and to assemble into the cartridge.

It is preferred that the diameter of the substantially discoidal shield member is substantially equal to that of the casing of the projectile, since such dimensions are beneficial in optimizing the shielding effect upon the fins and/or their pivotal mounts.

It is also preferred that at least that surface of the shield member facing said propellant charge is substantially smooth and flat. This both provides for economy of construction and reduces risk of unwanted deflection of the propellant charge wizen detonated. In some circumstances, however, it can be beneficial to shape said face somewhat, for example by introducing a slight amount of concavity, as by curvature of the shied itself or by thickening the rim of the shield relative to the central portions thereof.

Preferably again the shield member is made of metallic material; most preferably the same material as the casing so that, during storage of the assembled cartridge, there is no risk of galvanic action occurring between dissimilar metals, which could create conditions for unreliable firing.

It is further preferred that the shield member is adherent or otherwise attached to the projectile, and thus travels with the projectile after firing. This reduces any risk that an unattached shield member might be forced into unwanted motion, upon or after detonation of the propellant, and impact with the sleeve and/or some other component, thereby to potentially interfere with the desired firing process or cause damage to or endanger the firing personnel after ejection from the muzzle.

Where the shield is a substantially discoidal metallic member, it is convenient for its attachment to the casing of the projectile to be effected by means of a screw fitting. In one preferred embodiment, the surface of the member facing the projectile's casing is formed with an outstanding screw-threaded boss which is intended to be screwed into a threaded hole in the rear end of the casing in the vicinity of, and preferably directly inboard of, the pivotal mountings for said fins. Preferably, the diameter of the said boss is at least 50% of that of the shield member itself, and most preferably at least 60% thereof; such dimensions providing reliable retention whilst assisting in resisting any tendency for the shield to be tilted or otherwise distorted in response to any non-axial forces imparted thereto when the propellant is detonated.

In terms of absolute dimensions, one preferred embodiment employs a substantially discoidal shield of aluminum, the shield being 2 mm thick and 18 mm in diameter, with a screwed boss of diameter 11 mm protruding by 4 mm from that surface of the shield intended to face and lie adjacent the rear end of the projectile's casing. The other surface of the discoidal member, i.e. that intended to face the propellant charge, is in that embodiment, provided with a slot or other indentation facilitating the screening of the shield into the casing of the projectile.

BRIEF DESCRIPTION OF THE DRAWINGS

In order that the invention may be clearly understood and readily carried into effect, one embodiment thereof will now be described, by way of illustration only, with reference to the accompanying drawing, the single FIGURE of which shows, in exploded perspective view, components of a small arms projectile in accordance with one example of the invention.

DETAILED DESCRIPTION OF THE DRAWINGS

Referring now to the drawing, a projectile 1 comprises a hollow casing 2 which contains a warhead, together with safety, arming and firing means therefor which can conveniently take any of the forms described in the aforementioned international patent application, attention to which is hereby invited.

The projectile 1 has a generally circular cylindrical configuration about a central axis and is formed in this instance of aluminum castings. The warhead (not shown) and the casing 2 are usually provided as separately formed castings; interlocking means, such as co-operative screw threads, being provided to enable the castings to be secured together. Usually, the warhead and casing are joined together immediately prior to assembly with a cartridge of suitable bore.

The casing portion is provided with four fins 3 distributed symmetrically around its rearward end; the fins being individually hinged, as at 4 about respective pivots extending parallel to the axis of the casing 2 so that they can be deployed, as described earlier, when the projectile is fired, in order to stabilize its flight. In this embodiment the hinges are spring-loaded as indicated at 5, so that they are urged towards their deployed condition. As will be seen by reference to the aforementioned international patent application, the deployment of the fins 3 can, alternatively or in addition to the use of springs such as 5, be provided by spring-loaded pins that are part of the safety system of the projectile.

When the projectile as thus far described is assembled into a cartridge, a sleeve of the cartridge 100 (shown in phantom) surrounds the casing 2 and the fins 3, keeping the latter in their undeployed position, closely conforming to the external diameter of the casing 2. The cartridge also contains, in well known manner, a propellant charge 102 (also shown in phantom) located behind the projectile. The cartridge may then be positioned in a firearm, such as a standard shotgun with an unrifled cylindrical barrel, so that, when installed and detonated by percussive impact, the charge forcibly expels the projectile from the firearm.

As mentioned previously, one problem that can be encountered with projectiles as thus far described, or rather such projectiles as fitted into cartridges, is that, after detonation of the propellant charge in the cartridge, and before the projectile exits the muzzle of the firearm, the cartridge sleeve can be distorted, or even torn. This causes unreliable firing, either of the particular projectile that exhibits the problem, due to a decrease in chamber pressure where chamber gases can escape though to tear and/or distort the cartridge casing, or unreliable firing of a subsequently fired projectile whose motion is interfered with by residues, in the barrel of the firearm, of material from a distorted or torn cartridge sleeve from a previous firing, or such material interfering in any automatic action of the firearm itself.

It has been necessary to conduct extensive research in order to identify the cause of such problems and thereafter to find a solution therefor. This extensive research has shown that the forces generated by detonation of the propellant charge tend to cause the fins 3 to twist on their hinges 4 such that the fins and/or hinges exert tearing forces on the cartridge sleeve, with the undesirable consequences mentioned earlier.

In accordance with the example of the invention shown in the drawing, shielding means 6 is provided to shield the fins from the forces generated by detonation of the propellant charge, and to transfer such forces directly to the rear of the projectile in such a fashion that the energy resulting from the detonation of the propellant impacts uniformly on the projectile because of the shielding.

In one particular embodiment, as shown, the shielding means 6 comprises a substantially discoidal member 7 disposed coaxially with the casing 2 and located between the projectile and the propellant charge (not shown), thereby providing an effective shield which is economic both to produce and to assemble into the cartridge.

In this embodiment, the diameter of the substantially discoidal shield member 7 is substantially equal to that of the casing 2 of the projectile, since such dimensions are beneficial in optimizing the shielding effect upon the fins 3 and/or their pivotal mounts 4.

In addition, and as shown in the embodiment being described, at least that face 8 of the shield member 7 disposed towards said propellant charge is preferably substantially flat, providing both economy of construction and reducing risk of unwanted deflection of the propellant charge when detonated and increasing the likelihood of uniform expansion of the propellant gases.

The other face 9 of the shield member 7 must of course, at least in that annular region thereof which (when assembled) is closely juxtaposed with the rearward edges of the fins 3, be configured so as not to interfere with the deployment of the fins.

In this embodiment, the substantially discoidal shield member 7 is made of metallic material. Preferably in such circumstances the shield member 7 is made of the same material as the casing 2 so that, during storage of the assembled cartridge, there is no risk of galvanic action occurring between dissimilar metals, which could create conditions for unreliable firing. Plastics or other non-metallic materials, or composite materials (including plastic-coated metals), could be used alternatively if desired, however, for the shield member 7.

It is preferred that the shield member 7 is adherent or otherwise attached to the casing 2 of the projectile, and thus travels with the projectile after firing. This reduces any risk that an unattached shield member might be forced into unwanted motion, such as tilting or lateral motion, upon or after detonation, with the attendant possibility of undesired impact with the sleeve and/or some other component, thereby to potentially interfere with the desired firing process or to present a risk or danger to those firing the cartridge.

Where, as in this embodiment, the shield 7 is a substantially discoidal metallic member, it is convenient for its attachment to the casing 2 of the projectile to be effected by means of a screw fitting. In this embodiment, the face 9 of the member 7 disposed towards the projectile's casing 2 is formed with an outstanding screw-threaded boss 10 which is intended to be screwed into a threaded hole 11 in the rear end 12 of the casing 2; in the vicinity of, and preferably directly inboard of, the pivotal mountings 4 for the fins 3. In this example, the diameter of the boss 10 is about 60% of the outside diameter of the shield member itself, the absolute dimensions in this respect being 11 mm and 18 mm respectively.

In general, it is preferred that the diameter of the boss 10 is at least 50% of that of the outside diameter of the casing 2, since such arrangements have been found to provide reliable retention of the shield member 7 to the casing 2 of the projectile 1 whilst assisting in resisting any tendency for the shield 7 to be tilted or otherwise distorted in response to any non-axial forces imparted thereto when the propellant is detonated. It is stressed however that the invention is not limited to the use of such relative dimensions and that other arrangements can be used and in some circumstances may be preferred.

In this embodiment, the shield 7 is formed of aluminum, the shield being 2 mm thick, and the screw-threaded boss 10 protrudes by 4 mm from the surface 9 of the shield which, as aforesaid, is that intended to face and lie adjacent the rear end of the casing 2 of the projectile 1. The other surface 8 of the discoidal member is, in this embodiment, provided with a slot 13 or other indentation facilitating the screwing of the shield 7 into the casing 2.

If preferred on in addition, the outer rim 14 of the shield member 7 may be provided with knurling (not shown) through part or all of its thickness in order to facilitate screwing of the member 7 into the casing 2.

It will be understood that the illustrated embodiment described herein show an application of the invention only for the purposes of illustration. In practice the invention may be applied to many different configurations; the detailed embodiments being straightforward to those skilled in the art to implement.

The invention claimed is:

1. A projectile for a small arms weapon having a muzzle, the projectile having a casing and stabilizing fins, said stabilizing fins being pivotally mounted upon said casing and spring biased outwardly of the casing, for automatic deployment after leaving the muzzle;

wherein the casing is disposed within a cartridge having a sleeve surrounding the casing and stabilizing fins, the sleeve restraining said stabilizing fins in an undeployed position; the cartridge also containing a propellant charge intended, when detonated, to propel the projectile out of the sleeve and the muzzle;

wherein shielding means is provided to shield at least one of said stabilizing fins and their pivotal mountings, at least in part, from the detonation of said propellant, said shielding means comprising a substantially discoidal shield member disposed coaxially with the casing, between the projectile and the propellant charge, and having a diameter substantially equal to that of the casing; and wherein said shielding means is attached to the projectile and remains attached thereto after the projectile leaves the muzzle.

2. A projectile according to claim 1, wherein at least that face of the shield member disposed towards said propellant charge is substantially flat.

3. A projectile according to claim 1, wherein the shielding means is made of metallic material.

4. A projectile according to claim 3, wherein the shielding means and the casing are made of the same material.

5. A projectile according to claim 1, wherein attachment of the shielding means to the casing of the projectile is effected by means of screw fittings.

6. A projectile according to claim 1, wherein the shielding means has a first surface disposed to face the projectile's casing; said first surface being formed with an outstanding, screw-threaded boss intended to be screwed into a threaded hole in the casing; said threaded hole being directly inboard of said fins.

7. A projectile according to claim 6, wherein the diameter of the said boss is at least 50% of that of the shielding means itself.

8. A projectile for a small arms weapon having a muzzle, the projectile being arranged within a cartridge having a sleeve and containing a propellant charge at one end intended, when detonated, to propel the projectile out of the sleeve and the muzzle, comprising (a) a casing;

(b) stabilizing fins pivotally mounted on said casing and spring biased outwardly thereof for automatic deployment after leaving the muzzle, said stabilizing fins being restrained in an undeployed position by the cartridge sleeve; and (c) a substantially discoidal shield member connected with one end of said casing opposite the propellant charge, said shield member being coaxially arranged with said casing and having an outer diameter substantially equal to that of said casing for shielding said stabilizing fins and their pivotal mountings, at least in part, from the detonation of the propellant, said shield member remaining connected with said projectile after the projectile leaves the muzzle.

* * * * *